US006681425B2

(12) United States Patent
Leventhal et al.

(10) Patent No.: US 6,681,425 B2
(45) Date of Patent: Jan. 27, 2004

(54) ADJUSTABLE BEDRESTS POSITIONED UNDER A MATTRESS TO RAISE AND LOWER THE MATTRESS AT EITHER THE HEAD LOCATION, A FOOT LOCATION OR ANY OTHER LOCATION

(75) Inventors: Robert Leventhal, Los Angeles, CA (US); Paul Thomas, San Pedro, CA (US)

(73) Assignee: Banyan Licensing LC, Ft. Lauderdale, FL (US)

( * ) Notice: Subject to any disclaimer, the term of this patent is extended or adjusted under 35 U.S.C. 154(b) by 82 days.

(21) Appl. No.: 10/116,230

(22) Filed: Apr. 4, 2002

(65) Prior Publication Data

US 2003/0188386 A1 Oct. 9, 2003

(51) Int. Cl.[7] ..... A47C 31/00
(52) U.S. Cl. ..... 5/660; 5/659; 5/616
(58) Field of Search ..... 5/660, 659, 634, 5/633, 652, 655.3, 615, 616

(56) References Cited

U.S. PATENT DOCUMENTS

| | | | | |
|---|---|---|---|---|
| 2,769,182 A | * | 11/1956 | Nunlist | 5/615 |
| 3,161,219 A | * | 12/1964 | Danhi | 152/339.1 |
| 3,392,412 A | | 7/1968 | Aymar | |
| 3,426,373 A | | 2/1969 | Scott et al. | |
| 3,606,623 A | | 9/1971 | Aymar | |
| 3,667,075 A | | 6/1972 | Dallard et al. | |
| 3,781,928 A | | 1/1974 | Swallert | |
| 4,142,263 A | * | 3/1979 | Pierson | 5/660 |
| 4,309,783 A | | 1/1982 | Cammack et al. | |
| 4,527,298 A | | 7/1985 | Moulton | |
| 4,686,722 A | | 8/1987 | Swart | |
| 4,807,313 A | * | 2/1989 | Ryder et al. | 5/610 |
| 5,170,522 A | | 12/1992 | Walker | |
| 5,267,363 A | | 12/1993 | Chaffee | |
| 5,577,278 A | | 11/1996 | Barker et al. | |
| 6,012,186 A | | 1/2000 | Soltani et al. | |
| 6,311,348 B1 | | 11/2001 | Luff et al. | |
| 2001/0047549 A1 | | 12/2001 | Ulert et al. | |

FOREIGN PATENT DOCUMENTS

EP 0 630 635 A2 12/1994

* cited by examiner

*Primary Examiner*—Teri Pham Luu
(74) *Attorney, Agent, or Firm*—Alston & Bird LLP

(57) ABSTRACT

There is provided a bedrest including an inflatable bladder, which is in general a triangular shaped structure when inflated and a microprocessor based hand controller for inflating and deflating the bladder. The bladder contains an interior baffle which extend for primarily the length of the bladder fixed to interior walls of the bladder to form an inverse triangle inverse to the triangle formation of the bladder when inflated. The interior baffle therefore enables the structure to form more precisely into the desired triangular shape in order to perform a more effective position when inserted under the mattress in the head location of the bed. The microprocessor based hand controller enables an individual to inflate or deflate the bladder to any desired amount with a simple control. In addition, the hand controlled microprocessor permits computer programming so that the mattress can be automatically raised and lowered to different levels during different periods of time. An additional feature is that one does not need to simply continue to hold the switch down in order to raise or lower the bladder portion but instead can press a simple button after the entire hand controlled microprocessor has been preprogrammed so that any one of a number of different adjustments can be made and these can be made at any given time and preset to any given time and interval.

11 Claims, 6 Drawing Sheets

ADJUSTABLE BEDRESTS POSITIONED UNDER A MATTRESS TO RAISE AND LOWER THE MATTRESS AT EITHER THE HEAD LOCATION, A FOOT LOCATION OR ANY OTHER LOCATION

BACKGROUND OF THE INVENTION

1. Field of the Invention

The present invention generally relates to an adjustable bedrest positioned under a mattress. More particularly, the invention relates to an inflatable triangular-shaped bladder for use in raising the head or feet of a user and to a microprocessor for controlling the amount of air in the bladder.

2. Description of Related Art

Adjustable beds have found widespread use beyond non-ambulatory patients and are used in many homes among persons of all age groups, in particular beds that raise the head and/or feet. Among the devices used to raise the head or feet are inflatable air bladders intended for use with conventional beds. A number of patents disclose bladders for this purpose. For example, U.S. Pat. Nos. 3,392,412 and 3,606,623 to Aymer provide a bedrest having an inflatable bellows placed under a mattress and filled with compressed air. The bladder is filled with air by a conventional electric motor which is activated by a switch to turn the motor on and off.

Another adjustable bed rest is shown in U.S. Pat. No. 3,667,075 which discloses a bellows assembly placed under the mattress wherein the mattress is raised either at the head section or under the knee to different heights through the expandable bellows. The bellows assembly is activated by a motor containing three position switches that are manually turned upwardly to actuate respective spool valves. When the switches are turned downwardly, they operate respective solenoid valves.

The Cammack patent, U.S. Pat. No. 4,309,783, discloses an inflatable bladder that is triangular in shape. The bladder in Cammack includes flexible elements which extend from adjacent the apex to adjacent a sidewall of the triangle designed to limit the expansion of the bladder. These flexible elements of specific length are designed to reinforce maintenance of the general shape of the bag in its generally triangular shape. The control mechanism has two double acting rocker buttons associated respectively with valve outlets. Upon depression of a rocker button in one direction, the motor is energized at the same time that the valve outlet is opened, allowing air to be delivered to the air bag through a hose. The same rocker button rocked in the opposite direction enables air to be removed from the bag.

U.S. Pat. No. 5,170,522 to Walker discloses a foundation that has a first open top housing or recess located below a backrest plate. A first lift air bag is located in a first recess. When expanded, the first air bag has a generally triangular configuration so as to elevate the backrest plate in a generally upward inclined position. A second air lift bag is located adjacent the leg portion of the structure. When expanded, this has a generally trapezoidal configuration. An air mattress is located on top of the foundation and the air mattress is adapted to bend with the transverse plates when the plates are elevated with the first and second lift air bags. A hand control is used to control the operation of a pump to change the air pressure in the mattress and also to change the air pressure in the first and second lift air bags. The controller has air operated switches for regulating a pump to supply air to air mattresses and lift air bags. Switches also control separate solenoid valves that are used to direct to the air mattress and lift bags.

It is an object of the present invention to provide an inflatable bladder containing an interior baffle which assures that the bladder will be formed into a triangular shape for use as a bedrest. Another object of the present invention is to provide a hand held controller with a microprocessor for controlling the inflation and deflation of an inflatable bedrest. It is a further object of the present invention to provide a device for raising and lowering the head end and/or the foot end of a mattress that includes a triangular shaped inflatable bladder and a hand held microprocessor controller.

SUMMARY OF THE INVENTION

The above and other objects and advantages of the invention are achieved by the provision of an inflatable bladder, which is in general a triangular shaped structure when inflated. The invention also includes the use of a microprocessor based hand controller for inflating and deflating the bladder. The bladder and controller may be used with a conventional bed.

The bladder contains an interior baffle which is essentially is two sheets of material which extend for primarily the length of the bladder and are welded to interior walls of the bladder to form an inverse triangle inverse to the triangle formation of the bladder once it is inflated. The benefit of this interior baffle is that once the bladder is inflated, the baffle will cause the bladder to form into an appropriate triangular shape. Without this baffle, even though the overall structure of the bladder is intended to be triangular when it is inflated, the shape cannot be as precisely controlled without the baffle and the resultant bladder will form into possibly a circle or an oblong shaped object of non-triangular shape. The interior baffle wall therefore enables the structure to form more precisely into the desired triangular shape in order to perform a more effective position when inserted under the mattress in the head location of the bed.

The microprocessor based hand controller enables an individual to inflate or deflate either the bladder under the head area or the bladder under the knee area of the bed to any desired amount with a simple control. In addition, the hand controlled microprocessor permits computer programming so that the mattress can be automatically raised and lowered to different levels during different periods of time. An additional feature is that one does not need to simply continue to hold the switch down in order to raise or lower the bladder portion but instead can press a simple button after the entire hand controlled microprocessor has been preprogrammed so that any one of a number of different adjustments can be made and these can be made at any given time and preset to any given time and interval.

Thus, with the present invention there is provided a bladder and control system for raising and lowering the head and or leg area of a bed that is easy to install, simple in operation and one that may be used with a conventional bed.

BRIEF DESCRIPTION OF THE DRAWINGS

Figure 1:
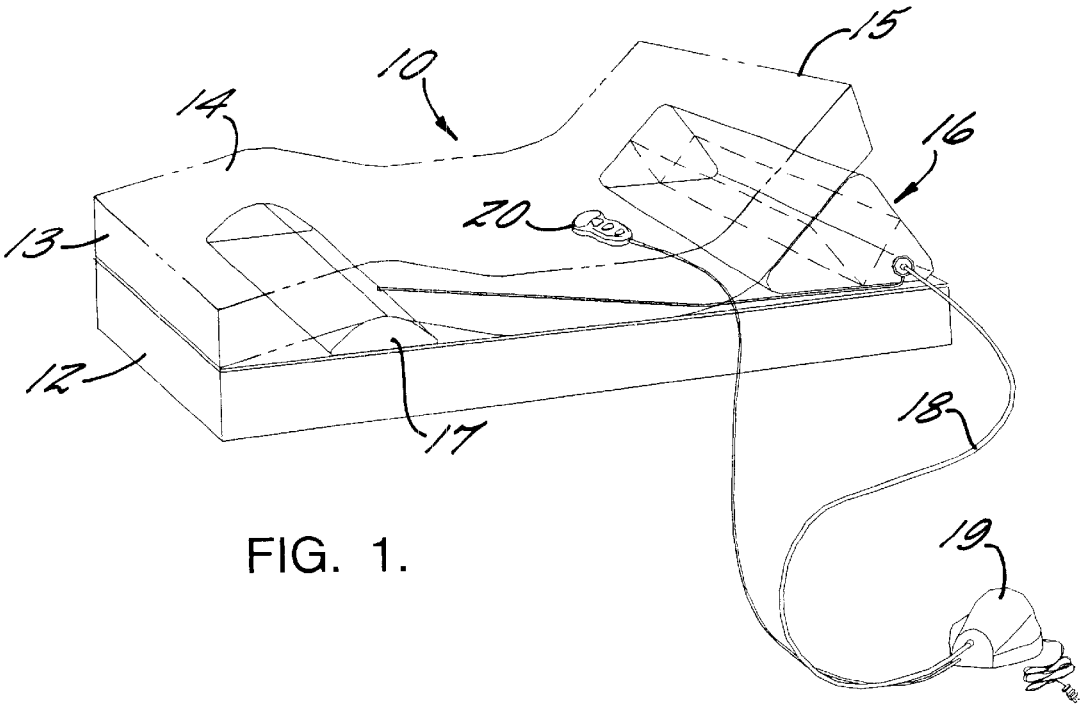
Figure 2:
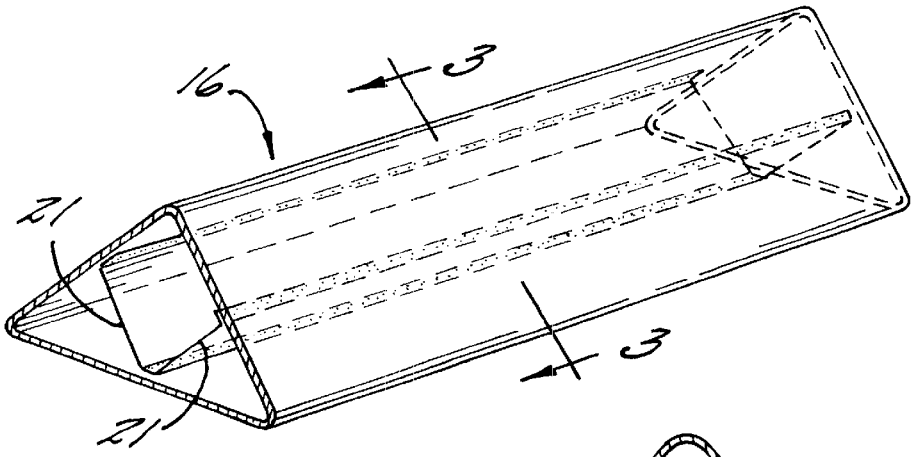
Figure 3:
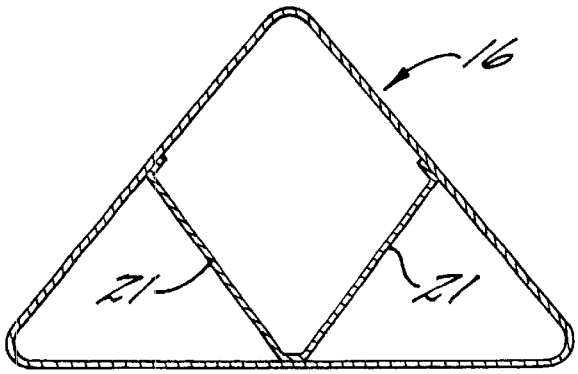
Figure 4:
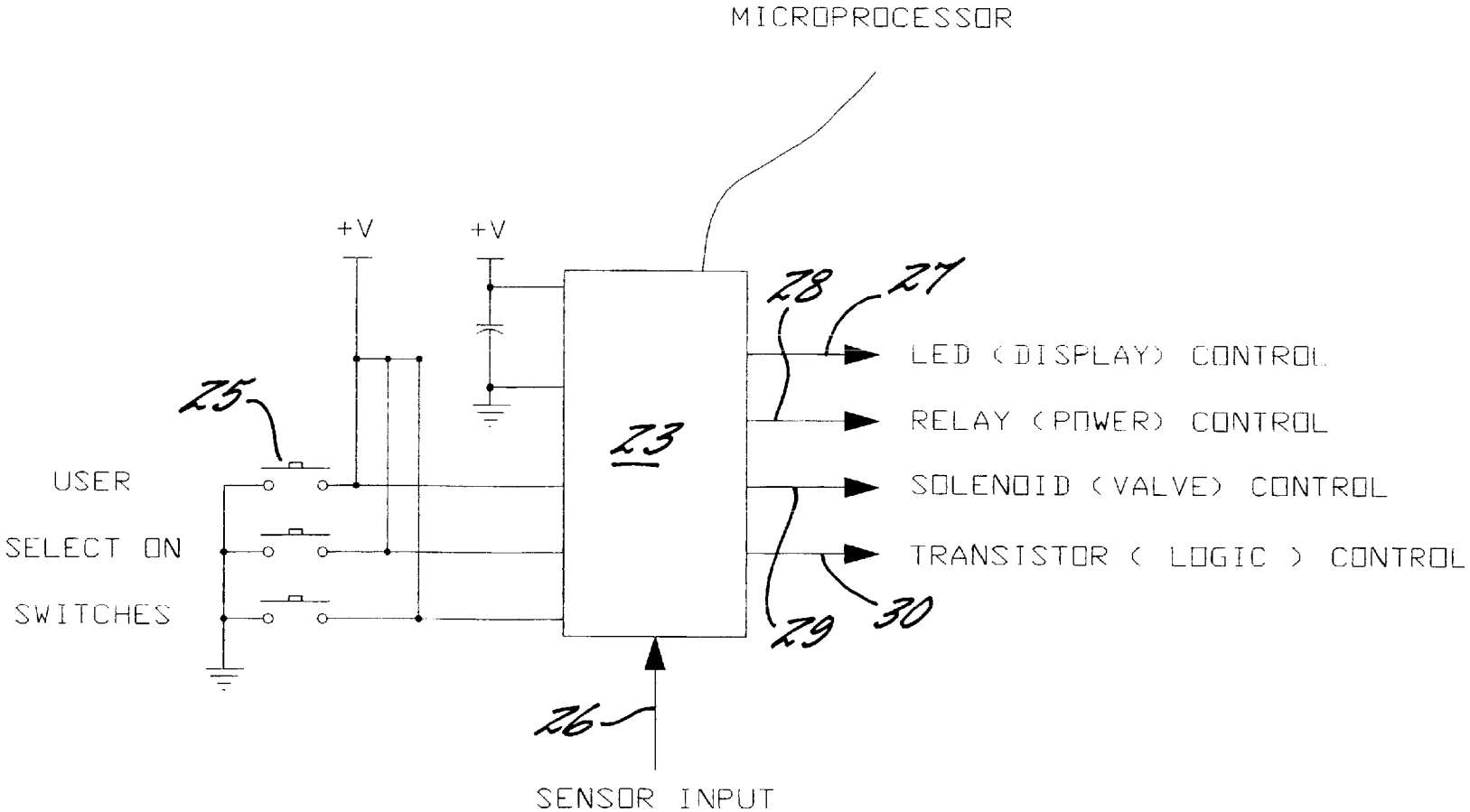
Figure 5:
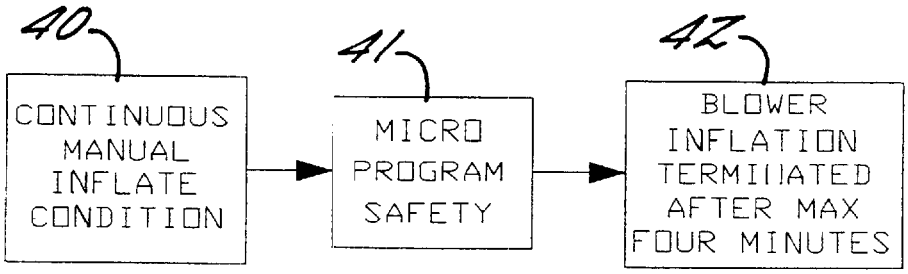
Figure 6:
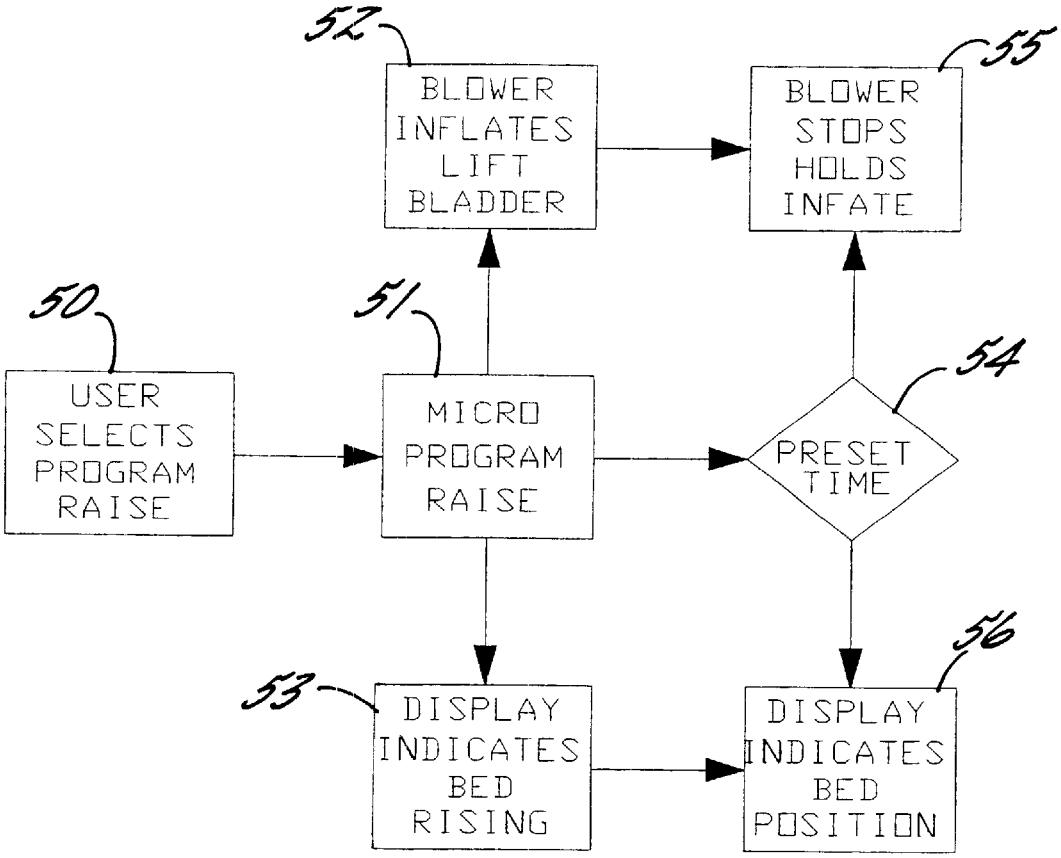
Figure 7:
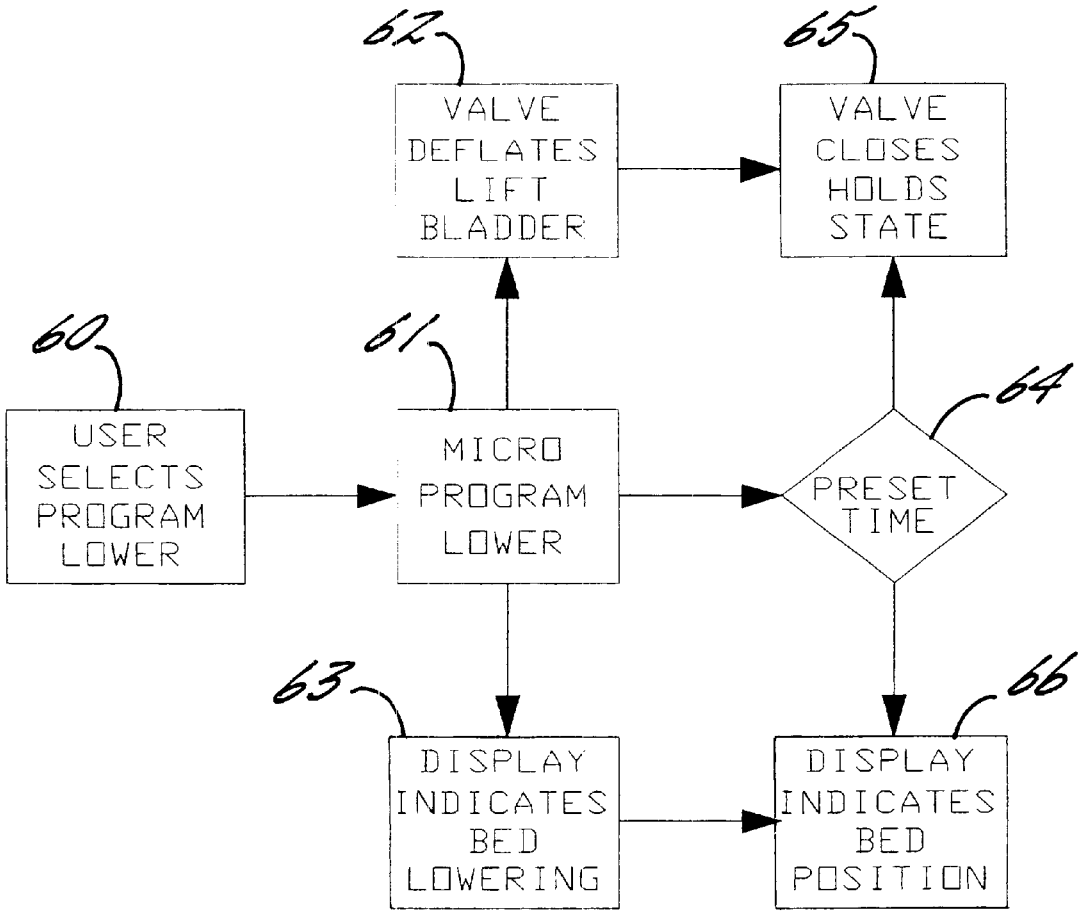
Figure 8:
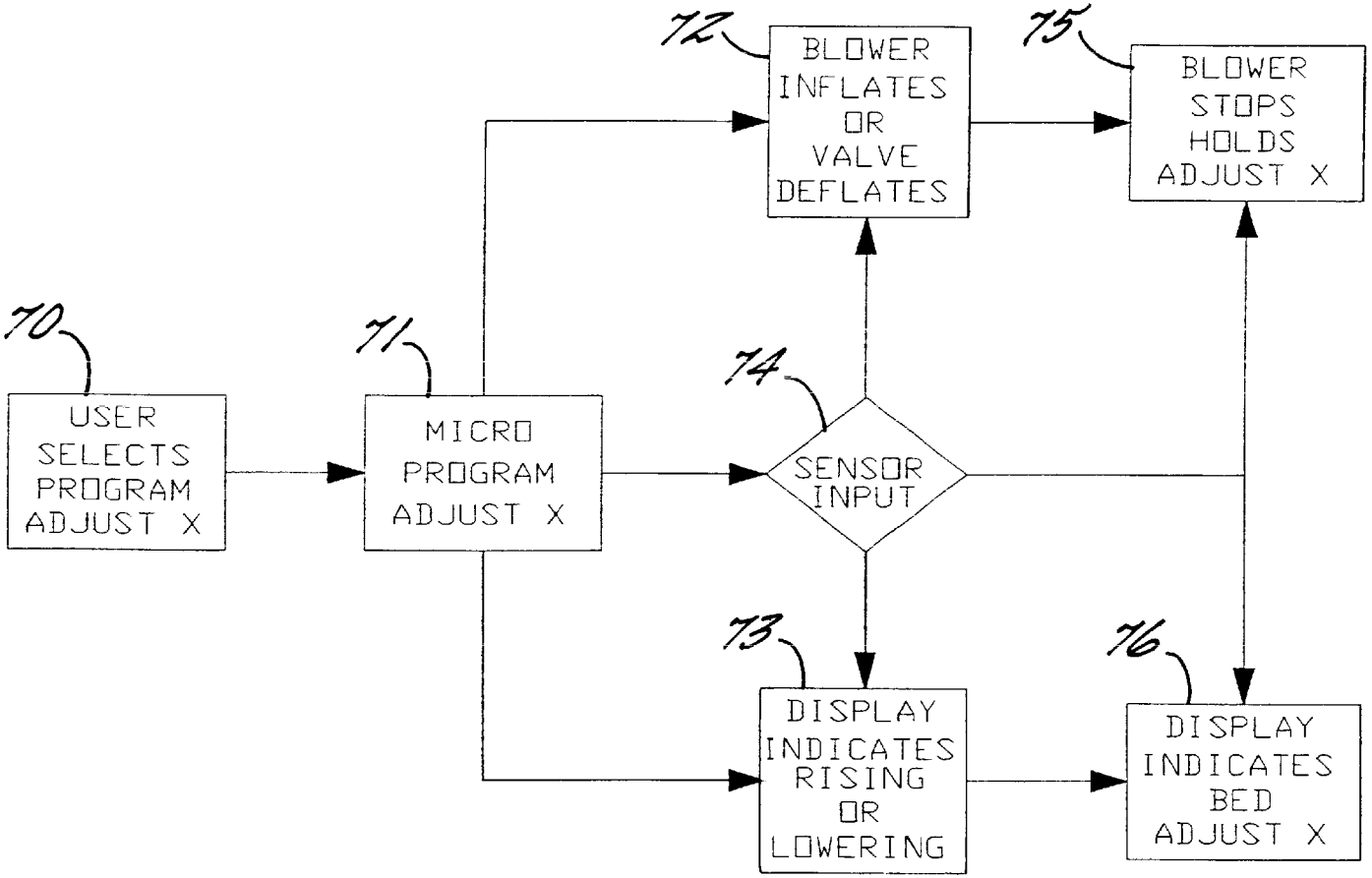
Figure 9:
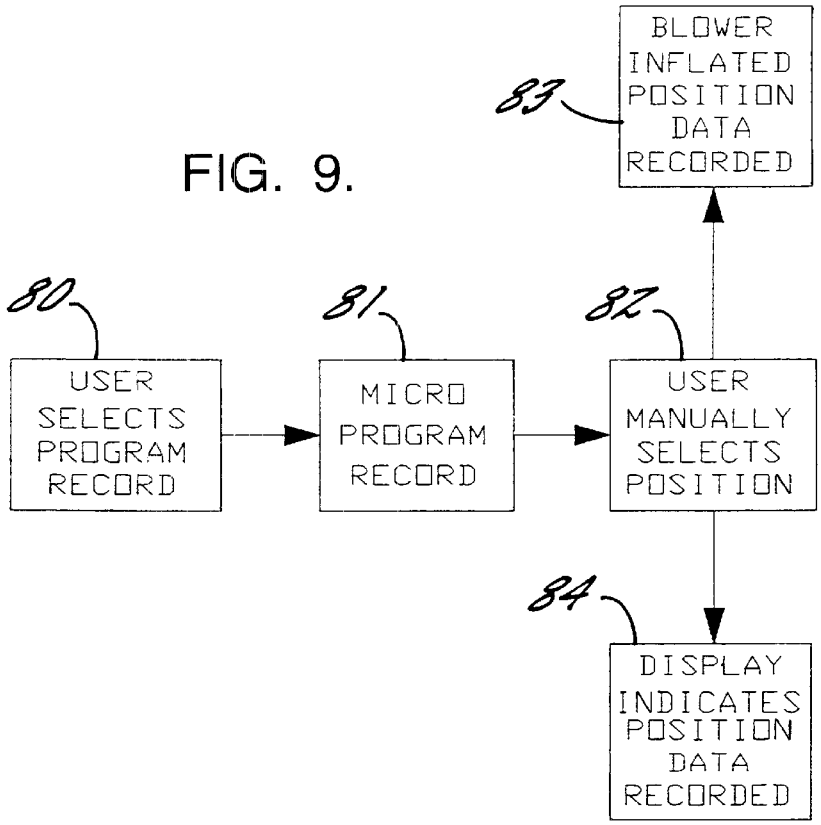
Figure 10:
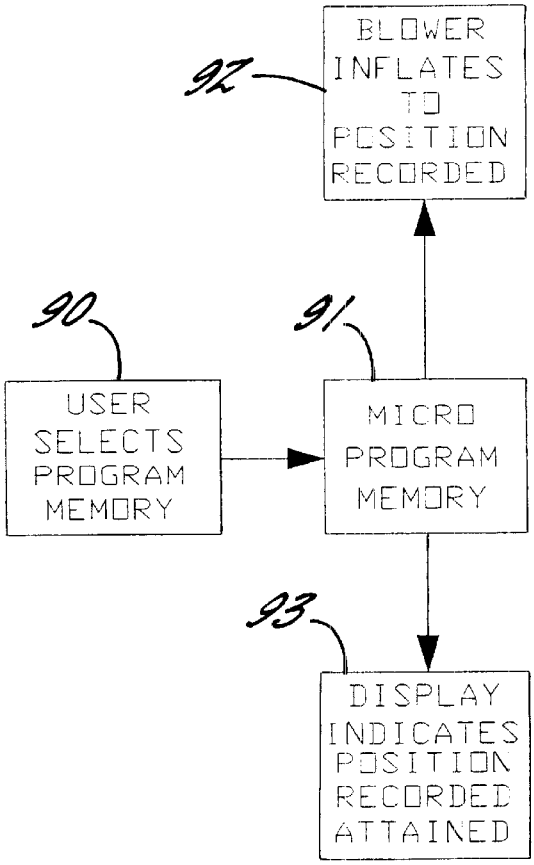

Having thus described the invention in general terms, reference will now be made to the accompanying drawings, which are not necessarily drawn to scale, and wherein:

FIG. 1 illustrates an adjustable bed according to the present invention showing a bladder of the invention at the head of the bed in an elevated position;

FIG. 2 is a view of the triangular shaped bladder of the present invention;

FIG. 3 is a cutaway view of the triangular shaped bladder taken along lines 3—3 of FIG. 2;

FIG. 4 is a schematic diagram of inputs and outputs of a microprocessor used in one embodiment of the present invention;

FIG. 5 is an operational block diagram illustrating the operations of the present invention to prevent over fill of the bladder of the bedrest according to one embodiment of the present invention;

FIG. 6 is an operational block diagram illustrating the operations of the present invention to inflate bladder of the bedrest according to one embodiment of the present invention;

FIG. 7 is an operational block diagram illustrating the operations of the present invention to deflate bladder of the bedrest according to one embodiment of the present invention;

FIG. 8 is an operational block diagram illustrating the operations of the present invention to inflate bladder of the bedrest to an adjusted position selected by a user according to one embodiment of the present invention;

FIG. 9 is an operational block diagram illustrating the operations of the present invention to allow a user to store a selected position for the bed rest according to one embodiment of the present invention; and FIG. 10 is an operational block diagram illustrating the operations of the present invention to placed the bed at a position previously stored by a user according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring more particularly to the drawings, FIG. 1 shows a bed 10 for use with the present invention. The bed 10 is generally rectangular and has conventional box springs or other suitable foundation 12, and a mattress 14. In other words, the bed used with the present invention may be a conventional bed. The mattress 14 has a head/back portion 15 and a leg/foot portion 13.

An inflatable bladder 16 having an air supply tube 18 for inflating and deflating the bladder is provided for raising and lowering the head portion 15 of the mattress. As shown in FIG. 1 there is also provided an inflatable bladder 17 placed under the knees of the user. It should be understood that bladder may be placed under the foot portion of the mattress. The air supply tube 18 is connected to a motor 19 that is controlled by hand held microprocessor 20.

As shown more clearly in FIGS. 2 and 3, the bladder 16, which is a triangular shaped structure when inflated, contains an interior baffle 21. The baffle 21 essentially is two sheets of material, which extend for primarily the length of the bladder and are welded to interior walls of the bladder to form an inverse triangle inverse to the triangle formation of the bladder once it is inflated. The benefit of this interior bladder is that once the bladder is inflated, the baffle will cause the bladder to form into an appropriate triangular shape. Without this baffle, even though the overall structure of the device is intended to be triangular when it is inflated, the shape cannot be as precisely controlled without the baffle and the resultant bladder will form into possibly a circle or an oblong shaped object of non-triangular shape. The interior baffle therefore enables the structure to form more precisely into the desired triangular shape in order to perform a more effective position when inserted under the mattress in the head location of the bed.

It will be understood that the inflatable bladder of the present invention may be made of any flexible air-tight polymeric materials. A number of such materials are known in the prior art, such as those materials typically used in the construction of swimming pool toys. Furthermore, the dimensions of the inflatable bladder may vary depending upon the size of the bed intended to be elevated. Preferably, however, the inflatable bedrest is of a width approximate that of the bed on which it is used.

In addition to providing a unique bladder arrangement, the present invention also provides a unique arrangement for manipulating the inflation and deflation of the bladder. Specifically, the present invention provides a microprocessor-based hand held unit wherein an individual can raise or lower the head area and knee area of the bed to any desired position with a simple control. In addition, the hand held unit permits computer programming so that the bed can be automatically raised and lowered to different levels during different periods of time. An additional feature is that one does not need to simply continue to hold the switch down in order to raise or lower the bed position but instead, can press a simple button after the entire hand controlled microprocessor has been preprogrammed so that any one of a number of different adjustments can be made and these can be made at any given time and preset to any given time and interval.

With reference to FIG. 1, the present invention includes an air supply tube 18 connected to the bladder and a pump motor 19 for providing air to the bladder. The motor includes a relay, not shown, connected between the motor and the AC outlet adapter 22. In addition, the pump motor also includes a release valve such as a solenoid valve, not shown, in communication with the bladder. When opened, the release valve releases air from the bladders to the atmosphere, thereby deflating the bladders.

Importantly, associated with the motor is a hand held unit 20. The hand held unit includes an interface having various switches that allow the user to communicate with the motor and release valve to inflate and deflate the bladder to thereby alter the position of the bed. Further, the interface of the hand held unit includes various indicators such as LED indicators and/or LCD displays that provide information to the user concerning the position of the bed and the control of the pump motor.

With reference to FIG. 4, the hand held unit includes a processor 23. The processor has inputs 26 connected to the selector switches 25 of the hand held unit 20 and an input 26 connected to a pressure sensor associated with the bladder 16. The processor also includes various outputs. An indicator output 27 provides display information to the LED indicators and/or LCD displays of the hand held unit. Further, the processor includes an output 28 to control the relay of the pump motor to thereby control the on and off condition of the pump motor. The processor includes an output 29 to control the release valve and logic control 30 for controlling the function of the pump motor. Importantly, associated with the processor 23 is computer software, such as machine code, or control logic for dictating the operation of the pump. Based on this software or logic and the selections made by the user via the switches 25, the processor of the present invention controls the pump motor to inflate and deflate the bladders so as to provide a desired position for the bed.

As with many conventional adjustable bed rest systems, the present invention does allow the user to manually select position for the bed. Specifically, by depressing and holding down the selector switches, a user can control the position of the bed. For example, if the user wishes to raise the mattress, the user can depress and hold the "up" button on the hand held unit. In this instance, the processor 23 of the present invention will receive this input and will control the pump motor to fill the bladder. The processor will periodically sample the input and will continue to fill the bladder until the user has released the button. Similarly, if the user depresses the "down" button on the hand held unit, the processor controls the release valve to open, and allows the bladder to deflate until the button is no longer depressed. In some embodiments, during deflation, the processor may also control the pump motor to pump air from the bladder to aid in deflation.

An important concern with manual inflation of the bladders is that the user may over fill and thus, possibly damage the bladders. As such, in some embodiments, the processor 23 further includes a maximum threshold value stored in memory. In this embodiment, during an inflation process, the processor periodically samples the input from the pressure sensor and compares this value to the stored threshold value. Once the pressure in the bladder equals the threshold value, the processor shuts off the pump motor, thereby preventing overfill of the bladders.

In an alternative embodiment, the processor may use a time duration to evaluate overfill. In this embodiment, the processor includes an over fill time threshold value stored in memory. Further, the processor includes either an internal or external clock or counter. With reference to FIG. 5, in operation, during a continuous inflate operation, (see block 40), the processor monitors the time duration of the inflation and compares it to the threshold value. When the time duration of the inflation equals the threshold value, the processor turns off the pump motor. (See blocks 41 and 42). As illustrated in FIG. 5, in one embodiment, the threshold value is four (4) minutes.

In yet another embodiment, the processor includes in addition to the over fill time threshold value, a current time value representing the time duration of inflation from an empty bladder state to the current position of the bed. In other words, if the bladder is completely empty, the current time value is zero, but if the bed is at a first position, the stored current time value equals to the time duration to inflate the bladder to the current position. In this embodiment, if the user controls the processor to further inflate the bladder, the processor counts the time that the bladder is being inflated and adds it to the stored current time value. This total value is then compared to the threshold value to ensure that the bladder is not over filled.

As mentioned previously, one problem noted with many conventional adjustable bed rest systems is that the user must continually depress the selector switch until the bladder has been inflated or deflated to place the bed in a desired position. The present invention, however, remedies this problem in several ways. Specifically, the processor of the present invention, using the computer software or logic may be controlled to inflate and deflate the bladder by merely short duration depressions of the selector buttons on the interface of the hand held unit.

For example, in some embodiments, the user may control the processor to fill or deflate the bladder to a desired level by selecting, via the button, a preset position. In this embodiment, the processor has stored in memory in table form different time durations for inflation of the bladders. Each time duration represents the amount time required for the pump motor to pump the bladder to a desired pressure, which corresponds to a desired position of the bed. The processor, either through a series of LEDS or a menu displayed on an LCD display, displays to the user the different possible positions. The user, via, the selector switches of the interface may choose a position for the bed.

For example, with reference to FIG. 6, if the user selects to raise the bed position, (see block 50), the processor, (see block 51), receives the input and retrieves from the table in memory the time duration associated with the selected position. The processor then controls the pump motor to inflate the bladder. (See block 52). Further, the processor also indicates to the user either by an LED or an LCD display that the bed is rising. (See block 53). The processor, using an internal or external clock or counter, counts for the duration of time associated with the position selected by the user. (See block 54). At the end of the time duration, the processor stops the pump motor, (see block 55), and displays on the LED or LCD display the new position of the bed. (See block 56).

FIG. 7 illustrates the process for lowering the bed position. If the user selects to lower the bed position, (see block 60), the processor, (see block 61), receives the input and retrieves from the table in memory the time duration associated with the selected position. The processor then controls the release valve to open, thereby deflating the bladder. (See Block 62). Further, the processor also indicates to the user either by an LED or an LCD display that the bed is lowering. (See block 63). The processor, using an internal or external clock or counter, counts for the duration of time associated with the position selected by the user. (See block 64). At the end of the time duration, the processor closes the release valve, (see block 65), and displays on the LED or LCD display the new position of the bed. (See block 66).

In some embodiments, the bed may already be at a first position prior to a new selection by the user. In this embodiment, the processor either has stored in memory the current position of the bed or determines the current position by reading the input from the pressure sensor. To alter the position of the bed, the processor compensates the time duration associated with the new position based on the current position of the bed. For example, if the bed is at a first position and the user wishes to reposition the bed to a higher position, the processor may subtract the time duration to raise the bed to the current position from the time for the processor to raise the bed from a deflated position to the new selected position. The processor then uses this calculated duration to control the pump motor to reposition the bed. A similar operation would be used to deflate the bed.

In an alternative manner, the processor could include stored incremental time duration values representing the time required to inflate or deflate the bladder and position the bed at different incremental positions. More specifically, the processor could include in the stored table a first stored time duration for inflating the bladder to a first position. For the second position, the table would include the time duration for inflating the bladder from the first position to the second position, and so on for all subsequent positions. It would also include similar values for deflation. In this embodiment, if the bed is at a first position and the user requests that the bed be moved to a third higher position, the processor would access the time durations for the second and third positions and inflate the bladder for the total time period. Further, if the user wishes to now move down to the second position, the processor would access the memory and retrieve the time interval to deflate the bladder to the second position. It would then open the release valve for this time duration.

It is understood that the processor may either store a few positions or have several preset position levels. The time durations are typically stored in a look-up table and referenced by their corresponding position. Further, it is understood that the user may not have to use a display menu to select a position. The user could just transition through the different positions by pushing and releasing the up and down buttons. For example, if the user wished to raise the bed up two positions from its current level, they could push the up button on the hand held device twice. The processor would receive the two inputs, access the time duration stored for raising the bed the two levels, and control the pump motor to fill the bladder for the total time duration.

FIG. 8 illustrates yet another embodiment of the operations performed to change the position of the bed. Specifically, the user via the buttons, selects an adjust position X for the bed. (See block 70). The processor receives the command and also receives and indication of the current pressure of the bladder from the sensor. (See block 71). The processor includes a stored table containing values that correlate pressure with selected positions of the bed. The processor determines from the table the current position of the bed based on the current value indicated by the pressure sensor. The processor then compares the position chosen by the user and the current position of the bed to determine whether the bladder needs to be deflated or inflated. The processor then using the value from the table associated with the position chosen by the user controls the pump motor to either inflate or deflate the bladder, (see block 72), and also displays on the hand held unit an indication that the bed is either rising or lowering. (See block 73). When the bed reaches the desired position as indicated by the pressure reading from the pressure sensor matching the stored value for the position, (see block 74), the processor stops the pump motor and indicates the new position on the hand held unit. (See blocks 75 and 76).

The present invention also allows the user to select and store their own preset positions for the bed. With reference to FIG. 9, in this embodiment, the user, via the buttons of the interface, places the processor in a record mode. (See blocks 80 and 81). The user then controls the processor to inflate or deflate the bladder to place the bed at a desired position. (See block 82). The user controls the processor to store this position and indicates the position on the hand held unit. (See blocks 83 and 84). Specifically, the when controlled, the processor receives the pressure input from the pressure sensor and stores this value in memory. This value represents the pressure the bladder must be to place the bed in the desired position selected by the user.

FIG. 10 illustrates the operation of the present invention when the user selects a user-stored preset position. Specifically, the user, via the interface of the hand held unit, selects a user-stored position. (See block 90). The processor retrieves the pressure value associated with the selected position. (See block 91). The processor inflates or deflates the bladder until the value input by the pressure sensor is equal to the stored value for the position. (See block 92). The processor also displays the position to the hand held unit. (See step 93).

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for use in controlling the position of an inflatable bedrest comprising;

a pump motor connected to a bladder of the inflatable bedrest for at least inflating the bladder;

a processor in communication with said pump motor for controlling the operation of said pump motor, wherein said processor includes a stored table containing a plurality of values each representing a value for inflation of the bladder to place the bed rest at a position; and an interface associated with said processor having at least one selector for providing commands to said processor, wherein a position for the bed rest can be selected by commanding said processor to retrieve a stored value representing the selected position and said processor controlling said pump motor to inflate the bladder based on the selected stored value to place the bed at the selected position.

2. A system according to claim 1 further comprising a release valve associated with the bladder of the bed rest, wherein said release valve in a closed position retains air in the bladder and in an open state releases air from the bladder.

3. A system according to claim 2, wherein said processor is in communication with said release valve and controls the closed and open positions of said release valve.

4. A system according to claim 3, wherein a position for the bed rest can be selected by commanding said processor to retrieve a stored value representing the selected position and said processor controlling said release valve to deflate the bladder based on the selected stored value to place the bed at the selected position.

5. A system according to claim 1, wherein said processor has a continuous inflation mode, wherein a user can manually change the position of the bed rest by continuous depression of the selector on said interface, and wherein said processor includes a stored maximum threshold value used by said processor to prevent over fill of the bladder.

6. A system according to claim 1, wherein the stored values associated with said processor each represent a time duration for filling the bladder of the bed rest, wherein if a position is selected for changing the position of the bed, said processor retrieves the time duration value associated with the selected position and controls said pump motor to inflate the bladder for the time duration value.

7. A system according to claim 1, wherein said processor in a record mode, allows a user to control said processor to place the bed rest at a desired position and store a value in said processor associated with this desired position, such that the processor in normal operation can be controlled to place the bed rest at the desired position by commanding the processor to retrieve the value stored for the desired position and control said pump motor to place the bed rest at the desired position.

8. A system according to claim 1, wherein the table associated with said processor includes a plurality of values each representing an increment of time for inflating the bladder from one position to a next position, wherein to move the bed rest from a current position to a selected position said processor retrieves the time durations for each position between the current position and the selected position and totals these time durations to create a total duration, and wherein said processor operates said pump motor to inflate the bladder during the total duration.

9. A system according to claim 1 further comprising a pressure sensor associated with the bladder of the air bed rest and in communication with said processor.

10. A system according to claim 9 wherein the table associated with said processor includes a plurality of stored values, where each value represents a position of the bed rest and wherein said processor can alter the position of the bed rest by selecting a value associated with the desired position from the table and controlling said pump motor to inflate the bladder until the pressure indicated by said pressure sensor equals the value selected from the table.

11. An adjustable bedrest system comprising: an inflatable bladder having an air supply tube for inflating and deflating said bladder for raising and lowering a portion of a mattress, said bladder comprising a flexible air-fight polymeric material, is a triangular shaped structure when inflated, and contains an interior baffle which is two sheets of material which extend for primarily the length of said bladder and are welded to interior walls of said bladder to form an inverse triangle inverse to the triangle formation of said bladder when inflated, and a controller for positioning said inflatable bedrest comprising;

a pump motor connected to a bladder of the inflatable bedrest for at least inflating the bladder;

a processor in communication with said pump motor for controlling the operation of said pump motor, wherein said processor includes a stored table containing a plurality of values each representing a value for inflation of the bladder to place the bed rest at a position; and an interface associated with said processor having at least one selector for providing commands to said processor, wherein a position for the bed rest can be selected by commanding said processor to retrieve a stored value representing the selected position and said processor controlling said pump motor to inflate the bladder based on the selected stored value to place the bed at the selected position.

* * * * *